US005904275A

United States Patent [19]

Suffa

[11] Patent Number: 5,904,275

[45] Date of Patent: May 18, 1999

[54] CLOSURE WITH SELF-CLOSING VALVE

[75] Inventor: Udo Suffa, Gefell, Germany

[73] Assignee: Zeller Plastik GmbH, Zell/Mosel, Germany

[21] Appl. No.: 08/737,228

[22] PCT Filed: May 18, 1995

[86] PCT No.: PCT/EP95/01896

§ 371 Date: Feb. 12, 1997

§ 102(e) Date: Feb. 12, 1997

[87] PCT Pub. No.: WO95/32129

PCT Pub. Date: Nov. 30, 1995

[30] Foreign Application Priority Data

May 19, 1994 [DE] Germany ..... 44 17 569

[51] Int. Cl.[6] ..... B65D 37/00

[52] U.S. Cl. ..... 222/494; 222/520; 222/525

[58] Field of Search ..... 222/494, 520, 222/525, 153.14, 153.06

[56] References Cited

U.S. PATENT DOCUMENTS

| | | | |
|---|---|---|---|
| 4,349,134 | 9/1982 | Schuster et al. . | |
| 4,506,809 | 3/1985 | Corsette | 222/525 |
| 4,869,399 | 9/1989 | Dubach | 222/153.06 |
| 5,005,732 | 4/1991 | Penn . | |
| 5,115,950 | 5/1992 | Rohr . | |
| 5,680,969 | 10/1997 | Gross | 222/525 |

FOREIGN PATENT DOCUMENTS

| | | |
|---|---|---|
| 2395682 | 1/1979 | France . |
| 2604153 | 3/1988 | France . |
| 1184961 | 3/1970 | United Kingdom . |

*Primary Examiner*—Philippe Derakshani
*Attorney, Agent, or Firm*—Woodcock Washburn Kurtz Mackiewicz & Norris LLP

[57] ABSTRACT

A closure with a self-closing valve is made available which is easily operable by exertion of pressure and has a simple design. A transport security is provided, which closes the valve reliably even in case of great stress.

11 Claims, 7 Drawing Sheets

CLOSURE WITH SELF-CLOSING VALVE

BACKGROUND OF THE INVENTION

1. Field of the Invention

The invention relates to a closure with self-closing valve. The closure can be used in particular with tubes, cans, bags and bottles preferably containing pasty or liquid substances.

2. Prior Art

EP-A-395 380 describes a liquid dispenser with a self-closing valve. The self-closing valve has a surrounding flange, a peripheral surface extending therefrom and a cover surface with a slit provided therein. The self-closing valve is arranged in the dispensing opening of a container, whereby the valve flange is held by a retaining ring on the edge of the dispensing opening. For delivery of liquid from the container, pressure is exerted thereon causing the self-closing valve to first be turned outwards, i.e. the valve is curved from a resting position in the region of its peripheral surface in such a way that the cover surface comes outwards. In the turned-outwards position, the slit is widened to form a dispensing opening as a result of the pressure exerted on the container. When the pressure on the container is reduced, the slit closes automatically and the valve arrives in its resting position by turning inwards. The container is ventilated by means of the slit which opens as a result of the partial vacuum in the container. This system is eminently suitable for many applications, particularly for use in containers which are stored with the opening facing downwards so that the product to be dispensed can be dispensed immediately by means of pressure on the container, such as e.g. for shower gel, shampoo or the like. It has turned out that the container ventilation of this well-known closure system does not always work reliably. With thin-walled containers in particular, this results in the container not returning to its original shape, but the container walls remaining in the pressed-in position.

EP-A-0 545 678 discloses a closure with a self-closing valve comprising a ring-shaped flange, a cylindrical peripheral surface extending from the flange and a cover surface having a cross slit therein. The valve's annular flange is L-shaped and is fixed at the dispensing opening of a container by means of a retaining ring. When the valve is in the resting position, the cover surface of the cylindrical peripheral surface is turned inside the dispensing opening. Pressure on the container causes the valve to turn outwards and even more pressure causes the cross slit to open up. When the pressure is reduced, the valve returns to its resting position. The container is ventilated by opening the cross slit in the resting position. Furthermore, a lid or a slide is provided which prevents unintentional dispensing of the product contained in the container. When the lid is closed, the self-closing valve cannot be turned outwards.

U.S. Pat. No. 5,115,950 describes a closure with a self-closing valve. The valve comprises a ring-shaped flange with a trapezoidal cross section which becomes thicker towards the outside. A peripheral surface that is directed towards the outside extends from the annular flange and a cover surface being curved inwards and having a cross slit extending from there. A cup is located inside the dispensing opening adjacent to the interior of the cover surface. This cup is held at the internal wall of the dispensing opening by means of bridges. Furthermore, the closure has a lid with two surrounding projections at the inside, which projections are in contact with the valve at the upper edge of the peripheral surface and in the area of the cup-shaped depression and press against the cup when the lid is closed. This is to prevent an undesired dispensing of the container's content. In this known closure, the ring-shaped flange is clamped between a locating face and a bendable bracket. Either the locating face or the bracket may have tooth-like projections that are to serve for an improved clamping of the annular flange.

SUMMARY OF THE INVENTION

The object underlying the invention is to provide a closure with self-closing valve which can be opened easily, seals reliably and has small dimensions, and also has container ventilation which works reliably even in case of small pressure differences This object is achieved with the features of the claims.

The invention solves the underlying problem based on the following.

The self-closing valve is arranged in its resting position in the closure in such a way that if there is a partial vacuum in the container, the annular flange bends out of shape at at least one location in such a way that a container ventilation occurs at this location. According to the concept of the invention, in its resting position the self-closing valve is prestressed or biased by a valve support element, which engages on the valve bottom or parts of the underside of the annular flange in such a way that the upper side of the annular flange is in contact with a corresponding annular sealing face of the closure. The prestress in the peripheral surface and the design of the annular flange ensure that the area between the annular flange and the matching sealing face is sealed. Because at least one part of the underside of the annular flange is not supported, this part of the annular flange can bend in the manner discussed before, i.e. can lift off from the sealing face and air can flow into the container through the gap thereby arising between the upper side of the annular flange and the sealing face.

According to one particular embodiment of the invention, the elastic valve capable of turning outwards is arranged between an upper part with a dispensing opening and a lower part such that in its resting position the surface containing the opening of the valve is in contact with a dish or cup in the lower part and the annular flange of the valve under stress rests, preferably self-centering, against the underside of the upper part around the dispensing opening. Between the upper part, the side wall of the valve and the lower part a side space is formed, which is in communication with a container from which the product is to be dispensed. The side space can be filled with the product standing under pressure by exerting pressure on the container. This causes the flange of the valve to be pressed sealingly against the upper part and the valve to be turned outwards through the dispensing opening by pressure on its side wall and to be opened for the discharge of the product. When the pressure is reduced, the elasticity of the valve causes it to be turned in again, the remaining product being sucked back due to the resiliency of the container. The bottom surface of the valve again lies sealingly on the dish of the lower part. In this position, the closure is sealed against an escape of the product without any additional measures. Only in this position of the self-closing valve, i.e. in its resting position, does a partial vacuum present in the container cause the annular flange to lift off from the underside of the upper part and, because of this, air can flow through it from the dispensing opening to the container. As soon as the pressure equalization is effected, the annular flange rests sealingly on the underside of the upper part again.

According to an alternative embodiment of the invention, the valve support element is arranged directly on the upper part. According to a further embodiment of the invention, instead of a dish, which partly or completely covers the slit area of the valve, a support is created, in which the slit area of the valve is uncovered vis-á-vis the container. For this, arms are preferably provided extending from the upper part (lower part) which support the valve in its resting position at, for example, four locations in the edge area of the bottom surface in such a way that the annular flange is held under stress against a matching sealing face on the upper part. In this embodiment, too, the underside of the annular flange is free and it can lift off if there is a partial vacuum in the container and so effect the container ventilation.

According to one particular embodiment of the invention, the valve support element is formed by a retaining ring which engages on the underside of the annular flange and presses it against a matching sealing face, whereby the underside of the annular flange is uncovered at at least one location, which causes this area of the annular flange to lift off if there is a partial vacuum in the container and to thus effect the container ventilation. Depending on the number of uncovered locations, the uncovered area of the underside of the annular flange can lie between 20° and 240°. In other words, only certain parts of the underside of the annular flange are pressed against the sealing face areas with the retaining ring.

The invention has the advantage that a container ventilation is ensured even in the case of small pressure differences, whereby the ability of the annular flange of the self-closing element to bend is utilized as container ventilation.

According to a further embodiment of the invention, a secure seal of the closure is provided, which serves in particular as a transport security. Here, the upper part is formed axially displaceable relative to the lower part, and the sealing face around the dispensing opening engages with a matching sealing face on the lower part in such a way that a sealed closing is achieved together with the self-closing valve located between them. In one particular embodiment of the invention, the annular flange of the self-closing valve is clamped between the upper part and the lower part. The ball cup at the lower part, which supports the valve, is closed. An annular projection extending in the direction of the dispensing opening in the upper part is preferably arranged on the edge of the ball cup. If the upper part is axially displaced relative to the lower part, the thin peripheral surface of the self-closing valve is pulled over this projection of the ball cup with prestress and the outer edge of the ball cup presses the annular flange against the sealing face on the underside of the upper part surrounding the dispensing opening. Here, starting from the annular flange, the peripheral surface of the valve is placed between the annular projection on the ball cup and the inner wall of the dispensing opening and from there further around the projection to the ball cup. If, in this position, the container is squeezed, the product cannot come out. The self-closing valve remains in the position thus fixed If the upper part is axially displaced upwards from the transport position into the working position, the shape of the self-closing valve changes due to the elastic properties of the silicone. The self-closing valve recovers its working shape. The flange of the valve moreover presses upwards against the sealing edge of the upper part. If the container is now squeezed, first, the product passes through the lateral opening in the lower part and presses the flange firmly against the sealing edge on the dispensing opening in the upper part, then further against the peripheral surface, i.e. the valve wall, the result of which is that the valve arches upwards making dispensing possible. Thus, the action described before takes place.

The transport security for the self-closing valve described above can also be used independently of the container ventilation described before. For example, a completely continuous retaining ring could press the entire underside of the annular flange firmly against the sealing face on the dispensing opening in the upper part. Here, too, the transport security can be used the same way.

Further advantages of the invention lie in its easy and simple operability and an inexpensive production. The advantage of the invention is particularly effective when it comes to containers such as tubes, cans, bags and bottles, which, on account of the material used and/or the wall thickness, have a low resiliency for going back into their starting position In the following, the invention is explained in more detail by means of examples and the drawings.

BRIEF DESCRIPTIONS OF THE DRAWINGS

FIG. 1 shows a first embodiment according to the invention in exploded representation, FIG. 2 shows the closure according to FIG. 1 in the resting position, FIG. 3 shows a cross section along the line A–A' in FIG. 2, FIG. 4 shows a top view of the embodiment according to the invention in accordance with FIG. 2, FIG. 5 shows the embodiment according to the invention in accordance with FIG. 1 in the secured state, FIG. 6 shows a further embodiment according to the invention in exploded representation, FIG. 7 shows the closure according to FIG. 6 in the resting position, FIG. 8 shows the closure according to FIG. 6 in the secured position, FIG. 9 shows a second embodiment according to the invention with the self-closing valve in the resting position, FIG. 10 shows the valve according to FIG. 9 in the ventilation position, FIG. 11 shows a third embodiment according to the invention with the self-closing valve in the resting position and FIG. 12 shows a top view of the embodiment of FIG. 11 without retaining ring and without self-closing valve.

DETAILED DESCRIPTION

Figure 1:
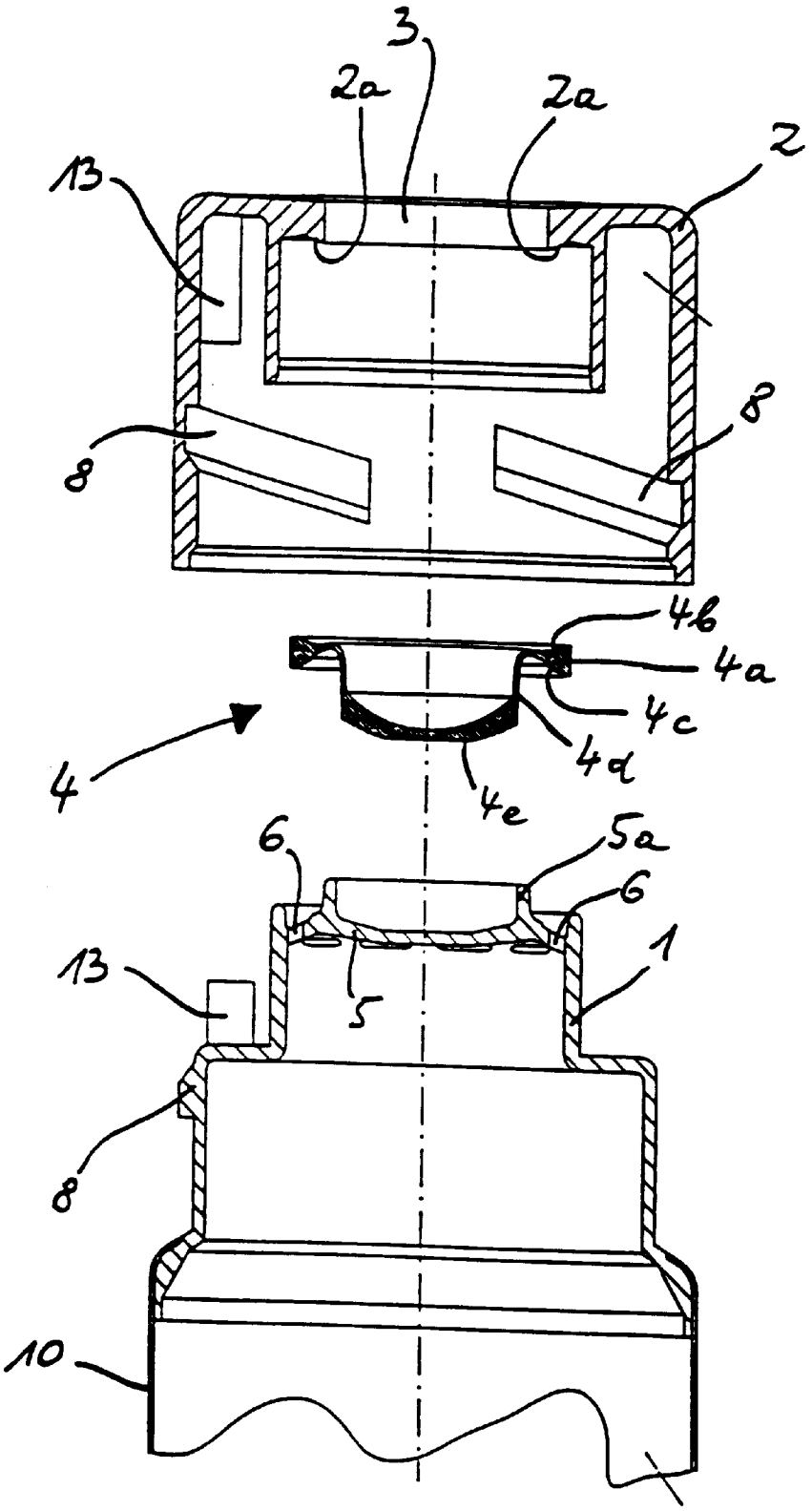
Figure 2:
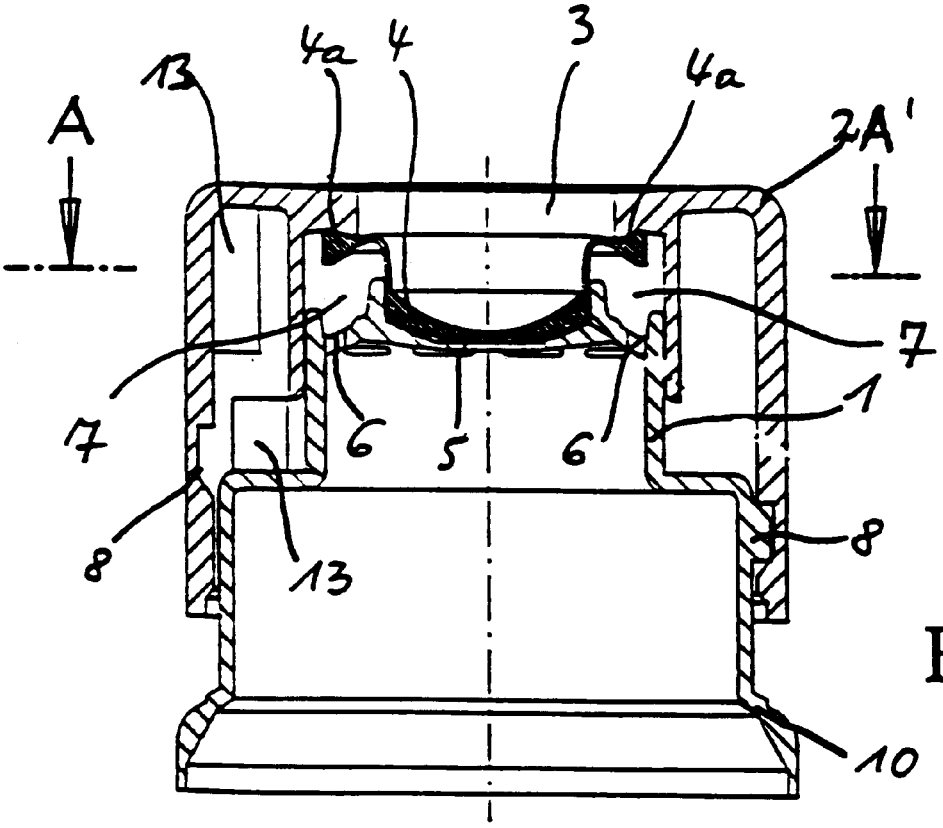
Figure 3:
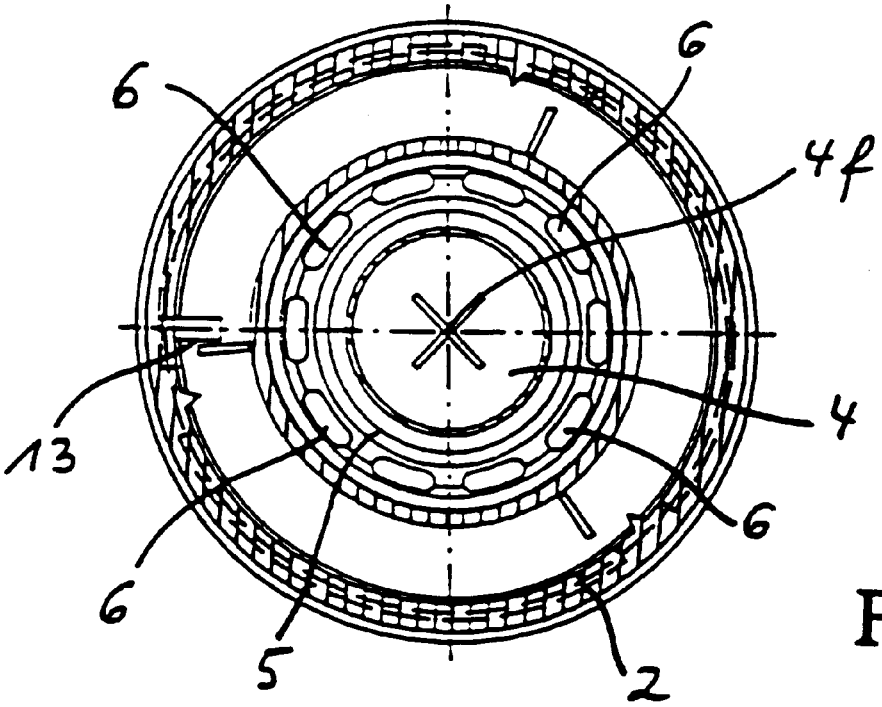
Figure 4:
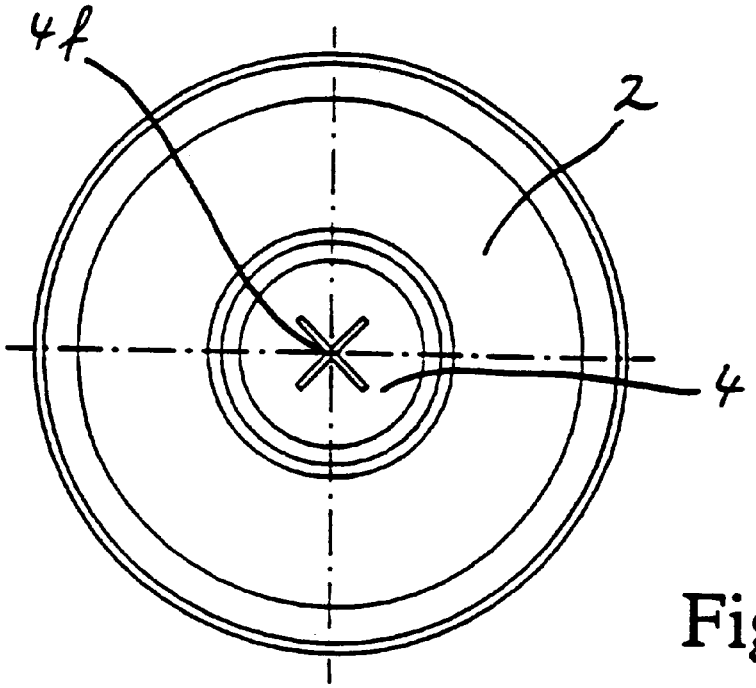

FIG. 1 shows a first embodiment according to the invention of a closure in exploded representation and FIGS. 2 to 5 show it in the composed state. A self-closing valve 4 is provided between an upper part 2 and a lower part 1. Preferably, a valve is used as described in EP-A-545 678. The valve 4 is in the resting position with its bottom surface 4*a* on a closed ball cup in the lower part 1 and rests with its annular flange 4*a* under stress against a sealing face 2*a* of the underside of the upper part 2. Above the valve 4, there is a dispensing opening 3 in the upper part 2. Between the upper part, the side wall of the valve 4 and the lower part 1, a side space 7 is formed, which side space is communication with the interior space of a container by openings 6, on which container the closure is provided (FIG. 2). As can be perceived in FIG. 3, the ball cup is arranged on the lower part by bridges, whereby the openings 6 are arranged on a circular ring around the dish 5. The opening of the valve 4 is formed as a cross slit 4*f*, which opens under pressure and automatically closes again. The lower part 1 is formed as an integrated component of a container, here as a tube 10.

During dispensing, the closure is in the position according to FIG. 2. When pressure is exerted on the tube, a product to be dispensed passes into the side space 7 and presses against the flange 4*a* and the peripheral surface 4*d* of the valve 4. The valve is lifted off from the dish 5 and turned outwards through the dispensing opening 3 causing the opening 4*f* to open and discharge the product. At the same time, the upper side 4*b* of the flange 4*a* is sealed off under pressure against the sealing face 2*a* on the underside of the upper part 2. If pressure is no longer exerted, the opening 4*f* closes, the valve 4 automatically turns in again and the bottom face 4*e* comes to lie on the dish 5. During this process any remaining product is drawn back into the tube 10 via the intermediate space 7 and the openings 6. Preferably, grooves extending radially are provided on the ball cup in the region of the edge, which facilitate the sucking-back of the product If a partial vacuum is present in the container, the annular flange lifts itself off at at least one location of the matching sealing face 2*a* on the underside of the upper part 2 and a ventilation of the container takes place between the upper side 4*b* of the annular flange and the sealing face 2*a*. As soon as the pressure equalization is reached, as a result of the stress present in the self-closing valve, the annular flange rests against the sealing face again and thus effects a sealed closure. The sealing face 2*a* has a slope matched to the upper side 4*b* of the sealing flange 4*a*. A self-centering of the valve 4 is thereby guaranteed.

Only under internal stress does the valve 4 rest against the upper part 2. This has the advantage that, after an emptying by lifting off the annular flange 4*a* from the upper part 2, the container can immediately be ventilated again and even small pressure differences can be equalized.

Figure 5:
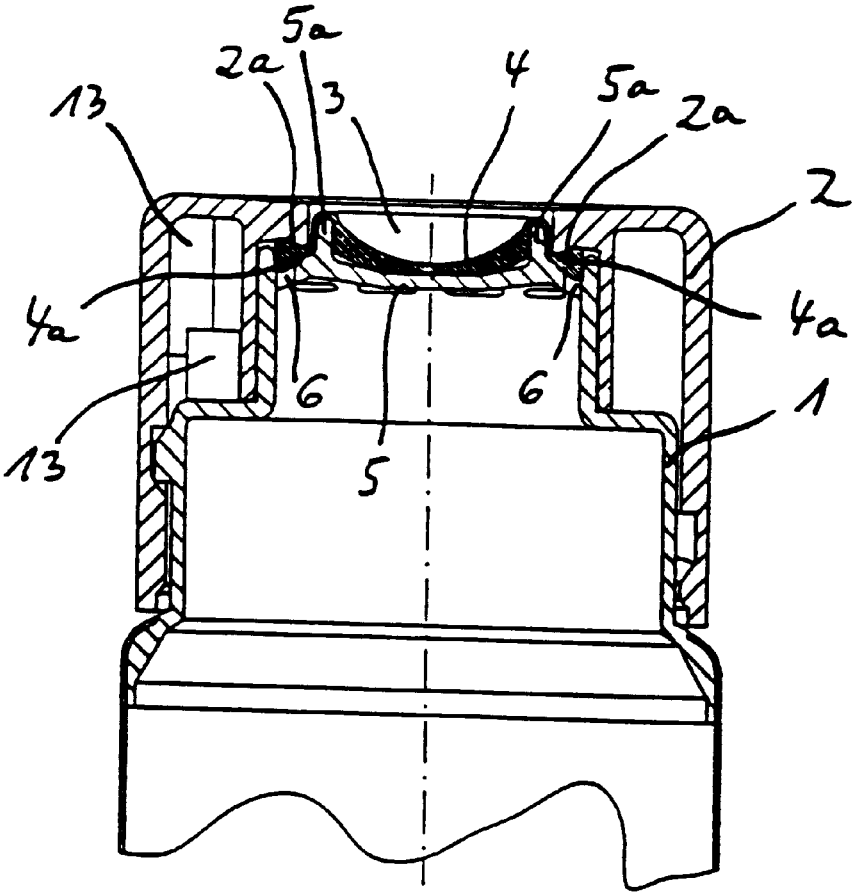

As transport security, the upper part 2 is formed axially displaceable relative to the lower part 1 via a coarse thread so that the valve 4 can be clamped between the upper part 2 and the lower part 1 (FIG. 5). The valve flange 4*a* is thereby clamped between a projection 5*a* on the edge of the dish 5 and the underside 2*a* of the upper part so that the valve 4 remains securely closed even if there is great stress, e.g. during transport. Before use, the upper part 2 is screwed on, so that the valve 4 becomes free again.

Figure 6:
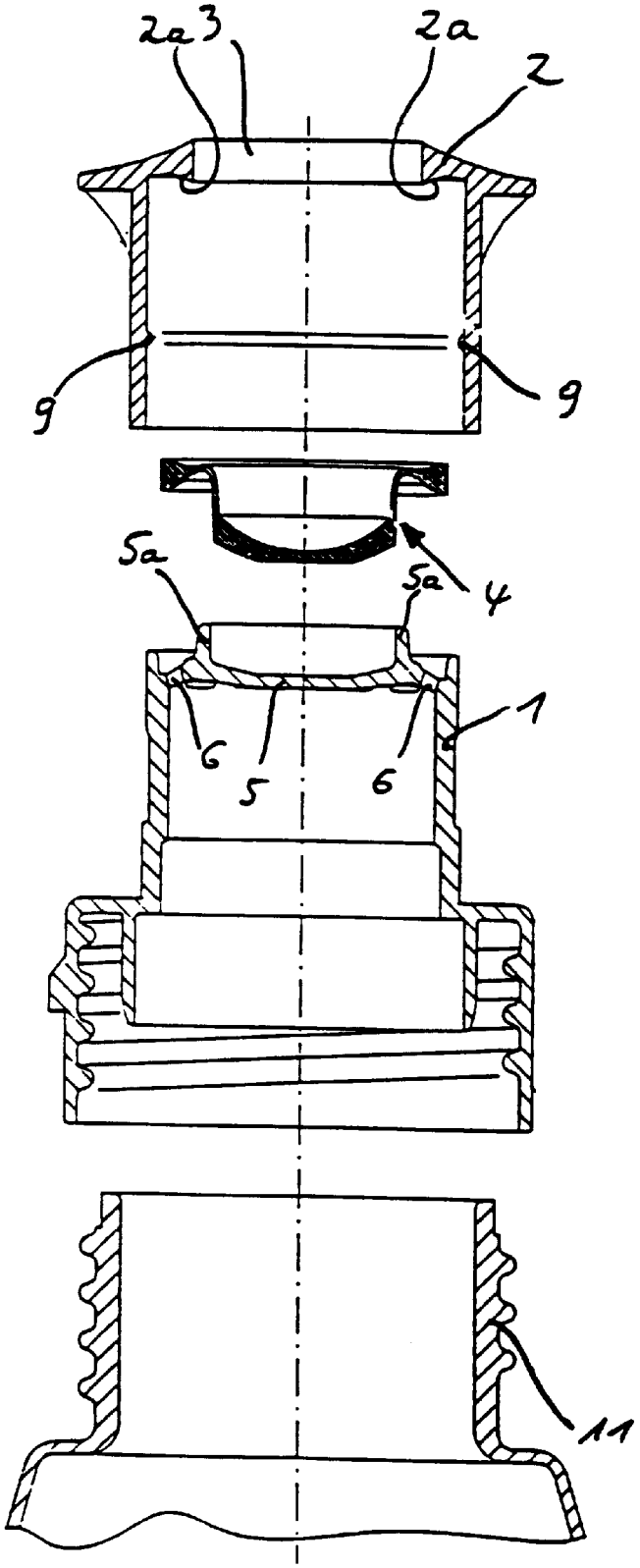
Figure 7:
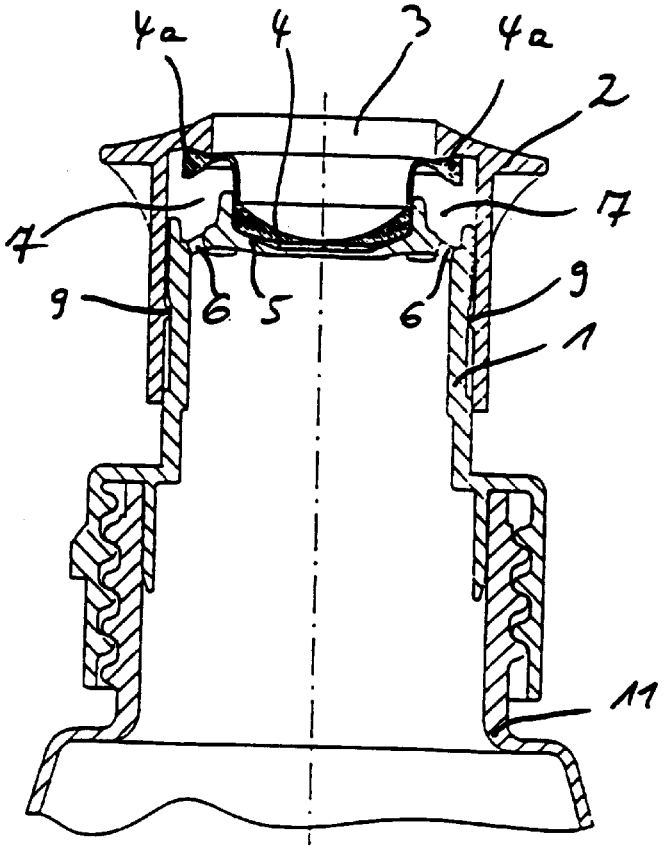
Figure 8:
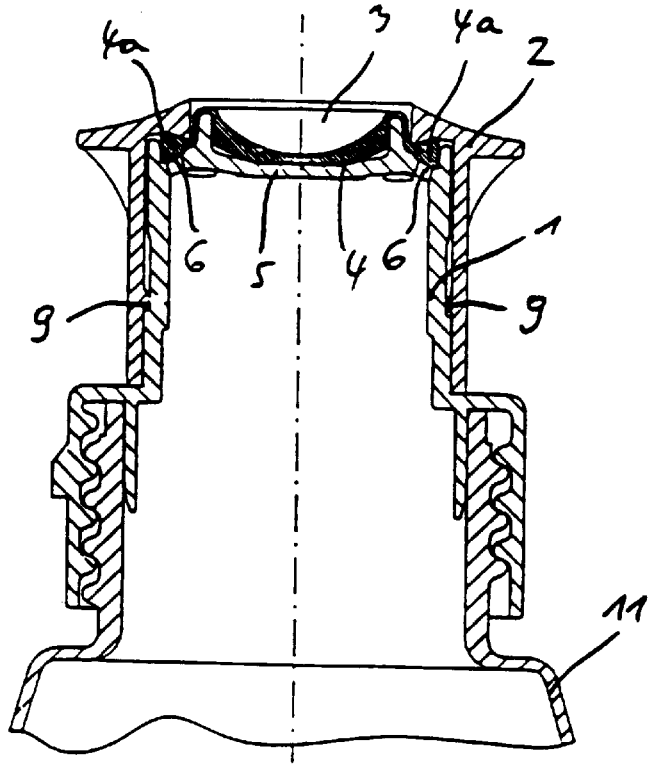

FIGS. 6 to 8 show an embodiment according to the invention, in which, for the transport security, the upper part 2 as a slide with stops 9 has to be movable on the lower part 1 in order to clamp the valve 4. The lower part 1 is screwed to the neck of a bottle 11.

If the upper part 2 is displaced relative to the lower part 1 by means of threads 8, the upper part 3 is secured against an overwinding by stops 13.

Figure 9:
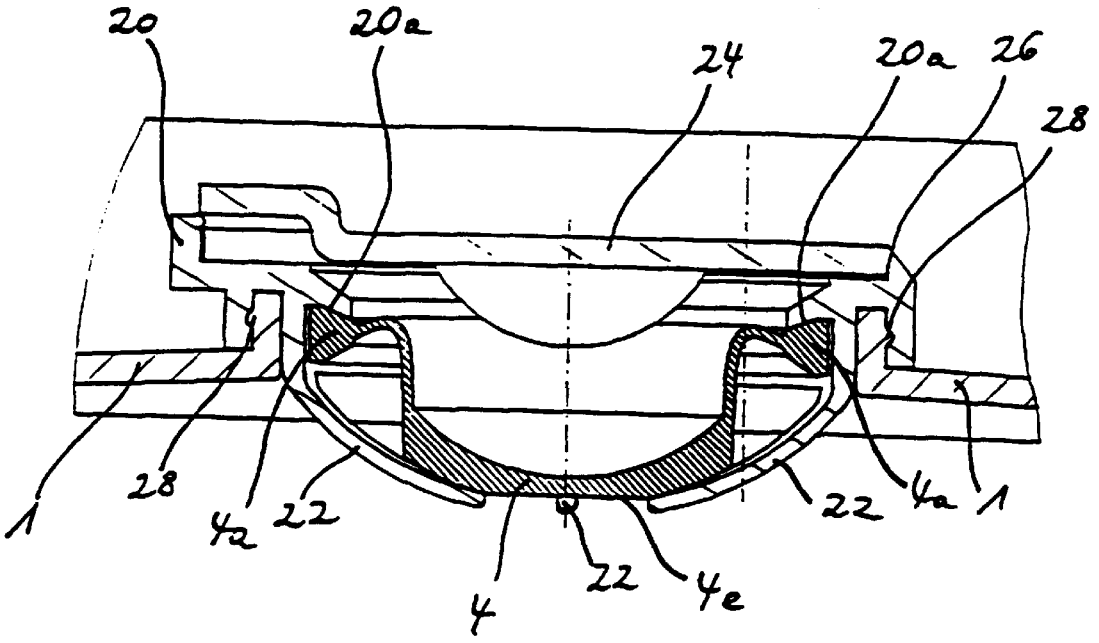
Figure 10:
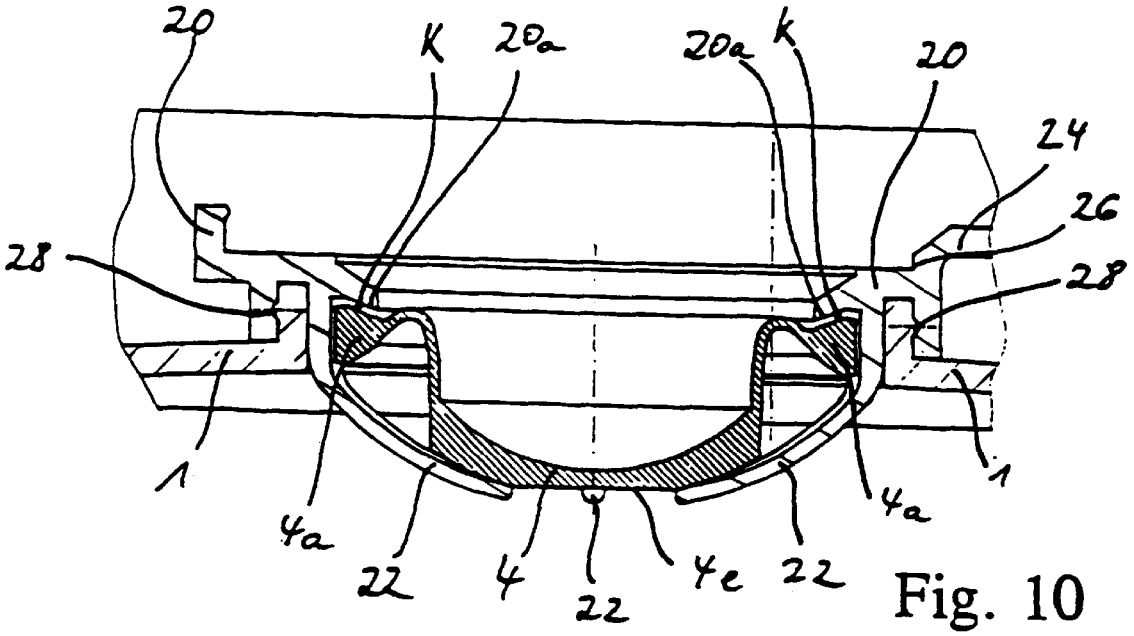

In a second embodiment according to the invention, which is represented in FIGS. 9 and 10, an upper part 20, in which the self-closing valve 4 is provided, is placed on a lower part 1. The upper part 20 has a continuous sealing edge 20*a*, against which the annular flange 4*a* of the valve 4 rests in FIG. 9. The upper part has four arms 22, which extend in a curve towards the inside of the container and in the edge region support the bottom face 4*e* of the valve 4 such that the flange 4*a* is pressed under stress against the sealing face 20*a*. Additionally, in FIG. 9 a cover 24 is provided for closing the dispensing opening in the upper part 20, which cover is swingable by means of a film hinge 26. The upper part 20 is connected to the underside 1 by means of a snap-in connection 28. Regarding the mode of operation, reference can be made to the above description. Here, too, the annular valve 4*a* can lift off from the sealing face 20*a* for the ventilation of the container, as is represented in FIG. 10 with cover 24 being pivoted. A ventilation channel K opens between the flange 4*a* and the sealing face 20*a*.

Figure 11:
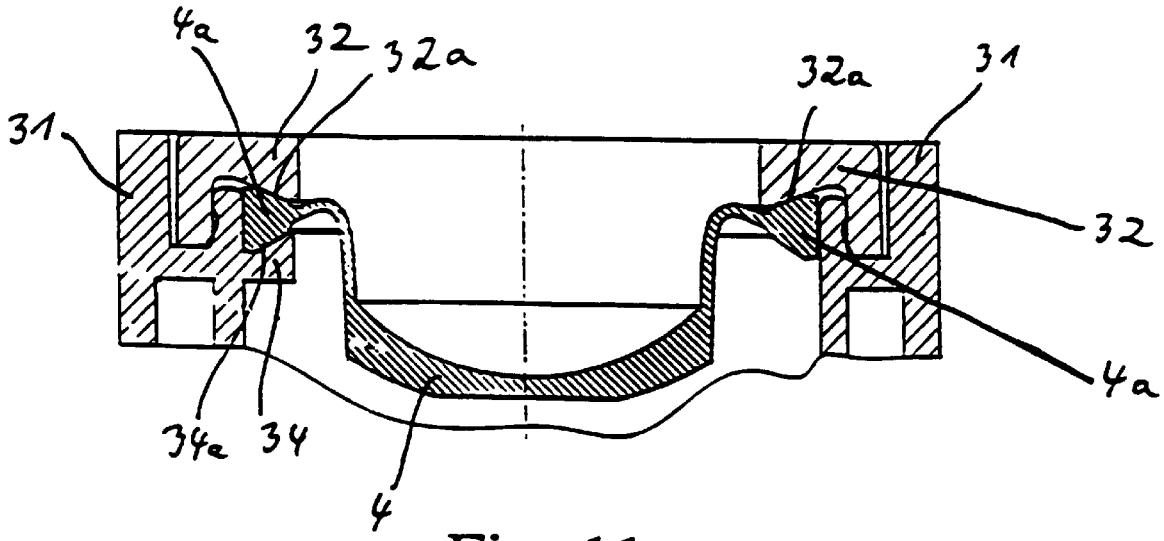
Figure 12:
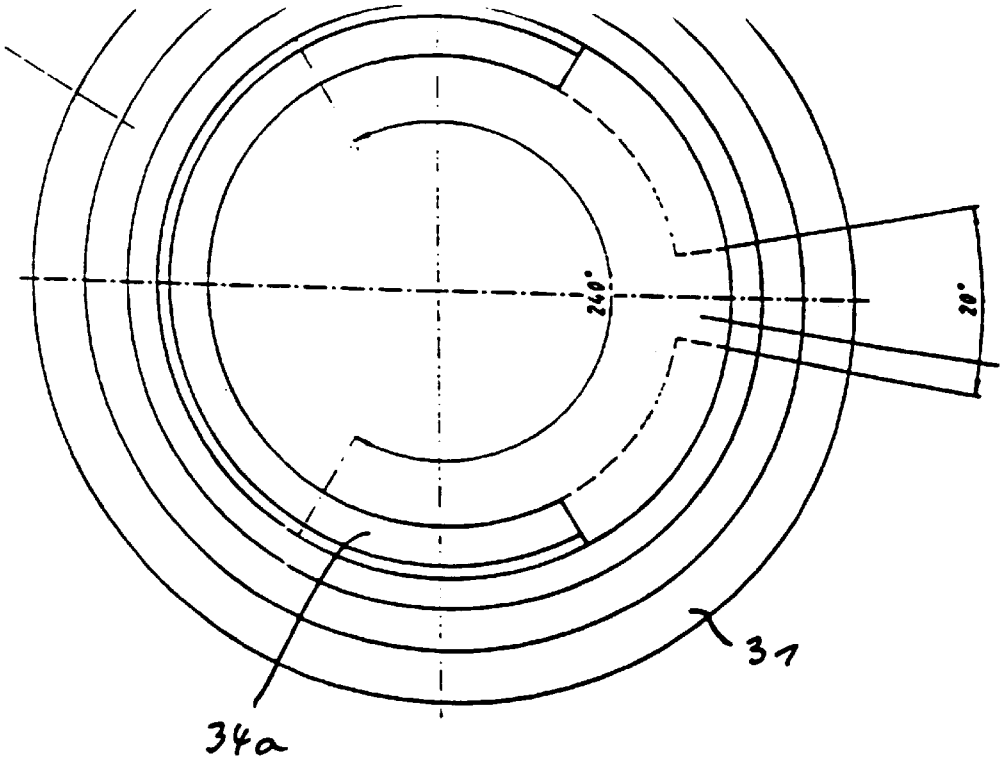

In a third embodiment according to the invention, in accordance with FIGS. 11 and 12, the self-closing valve 4 is clamped between the lower part 31 and a retaining ring 32 in the region of its annular flange. For this, the lower part 31 has a projection 34 with a sealing face 34*a*, which supports at least one part of the underside of the annular flange 4*a* and is clamped by the retaining ring engaging on the upper side of the annular flange 4*a*. The underside of the annular flange is uncovered in a range of preferably 20° to 240° and, if there is a partial vacuum present in a container, can lift off and effect the pressure equalization. FIG. 12 shows the top view of the embodiment of FIG. 11, in which both the retaining ring 32 as well as the valve 4 have been omitted for the sake of clarity. The sealing face 34*a* of the projection on the lower part 31 is clearly discernible.

Before the first use, the dispensing opening 3 in the upper part 1 can be protected by an injection molded, tear-off small panel or label to serve as tamperproof security.

Furthermore, a tear-off tamperproof security can be provided, which in the secured state prevents a displacement of the upper part 2 upwards before the first use.

I claim:

1. Closure for a container, wherein the closure comprises: an upper part (2) with a dispensing opening (3) and a sealing face (2*a*, 20*a*, 32*a*), a valve (4) having a bottom surface (4*e*), wherein a self-closing opening (4*f*) is provided, and an annular flange (4*a*), and a valve support element (5, 22, 34), which prestresses the self-closing valve with the annular flange (4*a*) against the sealing face (2*a*, 20*a*, 32*a*) such that the annular flange can be lifted off the sealing face at at least one location.

2. Closure according to claim 1, with a) a lower part (1), wherein b) the valve (4) rests with the valve flange (4*a*) on the underside (2*a*) of the upper part (2), c) the valve (4) is supported with its bottom surface (4*e*) on a dish (5) in the lower part (1) in the resting position, and d) openings (6) are provided between the dish (5) and the inner wall of the lower part (1), through which openings a product to be dispensed can be pressed into a side space (7) between the valve flange (4*a*), the peripheral surface (4*d*) of the valve (4), the lower part (1) and the upper part (2) under pressure so that the valve flange (4*a*) is pressed against the underside (2*a*) of the upper part (2) and the valve (4) is turned outwards through the dispensing opening (3) and is opened for the discharge of the product.

3. Closure according to claim 1 with an upper part (20), which has a surrounding sealing face (20*a*) and arms (22) extending in a curve towards the inside of a container, whereby the valve (4) is prestressed by the arms (22) such that the annular flange (4*a* ) is in contact with the sealing face (20*a*).

4. Closure according to claim 1 with a lower part (31), which has a projection (34), and a retaining ring (32), wherein the annular flange (4*a*) of the valve (4) is partly clamped between the projection (34) and the retaining ring (32).

5. Closure according to claim 1 characterized in that the upper part (2) is axially displaceable relative to a lower part (1) so that the valve flange **(4*a*) can be clamped between the edge of the dish (5) and the upper part and a turning-outwards and opening of the valve (4) is prevented and the valve (4)** becomes free again in the opposite direction to the displacement.

6. Closure according to claim 5, characterized in that the edge of the dish (5) has a sealing shoulder **(5*a*) for clamping and sealing the valve flange (4*a*)**.

7. Closure according to claim 5, characterized in that the upper part (2) is displaceable relative to the lower part (1) via a coarse thread (8), as a slide with stop (9) or as a bayonet system.

8. Closure according to any one of claim 1, characterized in that the lower part (1) is an integrated component of a container (10).

9. Closure according to any one of claim 1, characterized in that the lower part (1) can be screwed or snap-fitted onto a container (10).

10. Closure according to any one of claim 1, characterized by a tamperproof security.

11. Closure according to claim 10, characterized in that the tamperproof security is a detachable cover of the opening (3) of the upper part (2) or a detachable barrier to the displacement of the upper part (2) relative to the lower part (1).

* * * * *

UNITED STATES PATENT AND TRADEMARK OFFICE

CERTIFICATE OF CORRECTION

PATENT NO. : 5,904,275

DATED : May 18, 1999

INVENTOR(S) : Suffa

It is certified that error appears in the above-indentified patent and that said Letters Patent is hereby corrected as shown below:

Column 4, Line 18, delete "Descriptions" and insert --Description-- therefor.
Column 8, Line 1, in Claim 8, delete "any one of".
Column 8, Line 4, in Claim 9, delete "any one of".
Column 8, Line 7, in Claim 10, delete "any one of".

Signed and Sealed this

Fourth Day of July, 2000

*Attest:*

Q. TODD DICKINSON

*Attesting Officer*

*Director of Patents and Trademarks*